United States Patent [19]

Garnett et al.

[11] 4,453,481

[45] Jun. 12, 1984

[54] METHOD AND APPARATUS FOR CUTTING AND TACKING STITCHES

[75] Inventors: Frederick W. Garnett; James C. Kelly, both of Starkville, Miss.

[73] Assignee: Starkville Tool and Die Company, Starkville, Miss.

[21] Appl. No.: 283,808

[22] Filed: Jul. 16, 1981

[51] Int. Cl.[3] ..... D05B 65/00

[52] U.S. Cl. ..... 112/288; 112/301; 83/382

[58] Field of Search ..... 112/298, 288, 294, 297, 112/301, 285, 295; 83/382, 390, 607

[56] References Cited

U.S. PATENT DOCUMENTS

| | | | |
|---|---|---|---|
| 3,029,757 | 4/1962 | Smith, Sr. | 112/297 |
| 3,430,592 | 3/1969 | Florczak | 112/288 |
| 3,712,256 | 1/1973 | Striegler et al. | 112/288 |
| 3,848,555 | 11/1974 | Boser | 112/288 |
| 4,130,038 | 12/1978 | Zehnder | 83/382 X |
| 4,187,793 | 2/1980 | Fietta et al. | 112/288 |

*Primary Examiner*—Werner H. Schroeder

*Assistant Examiner*—Andrew M. Falik

*Attorney, Agent, or Firm*—Breneman, Kane & Georges

[57] ABSTRACT

A device for incorporating the leading edge of material such as threads or stitches in the initial stitches of a workpiece is provided by the utilization of a pneumatically activated clamp and cutting knife mounted forward of the throat plate and presser foot assembly of a sewing or stitching machine. The device for clamping, cutting and incorporating the leading edge of threads or chain stitches in the initial stitches of the workpiece is achieved by clamping, severing and thereafter adjustably releasing the threads or stitches after a predetermined number of needle penetrations. Once the threads or chain stitch is manually placed in the clamp and the device is activated, it thereafter operates automatically with the operation of the sewing or stitching machine to clamp the stitch in a position for incorporation in the initial stitches while automatically severing the chain stitch from the proceeding stitched workpiece and releasing the chain at a predetermined point in the sewing cycle as the chain is incorporated in the underside of the workpiece.

17 Claims, 6 Drawing Figures

METHOD AND APPARATUS FOR CUTTING AND TACKING STITCHES

BACKGROUND OF THE INVENTION

1. Field of the Invention

The present invention pertains to a device for incorporating the leading edge of chain stitches, threads or strings from sewing machines and the like, into the initial stitches of the workpiece to prevent the unravelling of the stitches or strings while producing a stitch that is even with and locked into the leading edge of the workpiece. More particularly the invention relates to a semi-automatic device which is economical to operate, does not interfere with standard sewing techniques and which incorporates the leading edge of stitches in the initial stitches in the underside of the workpiece.

The incorporation of the leading edge of chain stitches or thread in the underside of the workpiece is achieved by the utilization of a novel clamping and cutting apparatus which when engaged operates automatically to clamp and sever the stitches between successive workpieces while maintaining the alignment of the thread so that it can be incorporated in the seam in the reverse side of the garment in the initial stitches of the workpiece. The novel apparatus employs a pneumatically activated clamp and knife combination which upon activation first closes to engage and maintain the thread in alignment and thereafter results in the activation of a pivotable knife which coacts with the clamp to provide a scissor-like action to separate the trailing edge of stitches from the leading edge of stitches that are thereafter released at a predetermined point in the stitching cycle for incorporation in the leading edge of the workpiece.

2. Description of the Prior Art

The prior art includes a variety of devices for cutting chain stitches and for incorporating chains of stitches in workpieces. A number of the prior art devices pertain only to cutting or severing chain stitches while other devices pertain to a combination of cutting and including the leading edge of the chain stitch in a workpiece or garment. The effectiveness of a particular combination for incorporation of stitches into a workpiece or garment depends not only upon its reliability but also on such factors as the quality of the finished product, complexity of the mechanical device involved and the cost of installation and operation of the device. Furthermore, additional factors such as the compatability of the device with the normal sewing operation of the sewing or stitching machine operator are important in determining productivity and hence the subsequent acceptance of such latchback or tieback devices.

The prior art pertaining to systems for cutting and severing chain stitches employs a variety of mechanical thread severing and stitch cutting devices which have been known in the industry as latchback, backtack, and tieback devices and have been available for use in chain stitching and over-edge sewing machines. These devices are generally utilized with over-edge sewing machines such as Federal stitch type 504 to incorporate the leading edge of a chain stitch into the sewn stitches of the workpiece to prevent the unravelling of the leading edge of the chain stitch. These latchback devices generally come as attachments but in most cases are built into sewing machines that are used for sewing shirts and garments and more particularly sleeve ends, cuff ends, binding ends and hemmed bottom ends and other types of operation where a Federal stitch type 504 is utilized and where it is desirable to lock the leading end of the stitch chain into the sewn article to thereby prevent its unravelling.

A number of the prior art latchback or tieback devices rely upon a vacuum to assist in the orientation of stitches after the separation of the stitches between workpieces. Representative of such prior art devices are Palacino U.S. Pat. No. 4,220,105; Marforio U.S. Pat. No. 4,038,933; Boucraut U.S. Pat. No. 3,490,403 and Launer U.S. Pat. No. 3,698,336. In Palacino '105, severed stitches are drawn by a vacuum to a gripping apparatus which maintains the stitches in a predetermined position with respect to the sewing needle so that the leading end of the stitches can be incorporated into the underside of the workpiece during the initial sewing operation on the next proceeding workpiece.

Unlike the present invention, Palacino orients stitches utilizing a guide and gripper means after the stitches have been severed. In addition, the gripper of Palacino is not released at a predetermined point in the sewing cycle but instead grips the stitches until the chain is pulled by the sewing machine from the gripping device. Other vacuum assisted prior art such as Marforio '933; Boucraut '403 and Launer '336 do not positively grip the chain of stitches but instead rely entirely upon the vacuum source to maintain the position of the chain as the sewing operation is initiated. As a result, the prior art fails to provide for the necessary adjustment of gripping force necessary for reliability and reproducibility of results for a variety of garments and stitching threads to prevent puckering which results when the stitches are held too long or a faulty lock for the stitches when they have not been tensioned sufficiently.

The prior art pertaining to the engaging and alignment of severed chain stitches as is represented by prior art such as Palacino U.S. Pat. No. 4,220,105; Marforio U.S. Pat. No. 4,038,933; Boucraut U.S. Pat. No. 3,490,403 and Launer U.S. Pat. No. 3,698,336 furthermore require extensive modification of sewing machines and in some cases are not compatible with existing equipment or the standard sewing techniques of sewing machine operators. In addition, such prior art devices are fairly expensive to install and to operate since a vacuum source is required to assist in the engagement and orientation of severed chain stitches.

Other prior art patents such as Lawber U.S. Pat. No. 2,756,704 and Palumbo U.S. Pat. No. 2,854,937 are representative of entirely manual and mechanical type devices for orienting, fixing and severing chain stitches from a preceeding garment which assist in the incorportion of the leading end of stitches into the subsequent garment. As will be recognized by those skilled in the art, prior art such as Lawber, '704 and Palumbo '937 do not provide for the incorporation of the chain stitch in the underside of the garment but instead incorporate the stitches on the topside or facing side of the garment. Such chain stitch devices consequently leave a detectable leading edge of the stitch on the top side of the garment which in many cases detracts from the saleability of an article. Typical devices such as these are discussed and critically evaluated in Palacino U.S. Pat. No. 4,220,105.

In addition to failing to incorporate the initial stitches in the preferred underside of the garment, such prior art devices do not provide a positive system for releasing the stitch chain at a predetermined point in the sewing cycle so that once the leading edge has been incorporated in the stitched garment for a predetermined distance the stitch chain is released to thereby prevent puckering of the garment that can otherwise result from a lengthy engagement of the strings during the sewing operation. As a result, many of the prior art devices available for incorporation of stitches in the leading edge of the garment have resulted in the stitches being too firmly tensioned into the initial stitches resulting in puckering or a too loose alignment of the initial stitches which results in misalignment and conceivable loss of proper stitch locking within the garment, which problem is compounded by variations in the speed of starting and running the stitching machine. In addition, many of the prior art latchback, tieback, and backtack devices unduly impede the traditional sewing techniques of the sewing machine operator and as such suffer the disadvantages of longer training periods and reduced productivity. Some of the prior art devices as a consequence of design, size, and disposition require extensive modification and have proved to be unduly expensive in their application to industrial stitching and sewing machine equipment.

The configuration and disposition of the novel latchback mechanism of the present invention is relatively compact and is disposed away from the congested area of stitching machine needle presser foot and throat plate combination and cooperates in conjunction therewith in a manner that does not impede the normal routine of the stitching machine operator in the stitching and removal of garments from traditional chain stitching machines. In addition, the semi-automatic device of the present invention provides greater reliability, increased productivity, and increased repeatability of incorporation of chain stitches in the leading edge of the garment since it does not impede the normal operation of the sewing machine operator nor result in the pulling of stitches from a clamping device resulting in puckering or result in too loose stitches being missed in the stitch locking operation.

SUMMARY OF THE INVENTION

The disadvantages and limitations of prior art latchback devices including the problem of compatibility of the latchback devices with the variety of chain stitching and sewing machines available on the market and the interference of such devices with the normal operating procedures of the sewing machine operator have been obviated by the utilization of novel latchback mechanisms constructed in accordance with the present invention. The novel latchback device of the present invention is disposed forward of the stitching or sewing machine needle and presser foot assembly and is preferably level with the sewing top so as to not obstruct free operation of the sewing machine or the standard techniques employed in sewing garments.

As a consequence of the design and construction, the novel latchback device is conveniently added to new or existing sewing or stitching machines and is economical in construction and operation. The latchback device further produces sewn garments or workpieces of consistent and better quality by providing positive clamping and cutting of the stitch chain and the locking of the stitch chain in the underside of the garment.

The novel latchback device of the invention reduces operator training time, results in less needle breakage, promotes higher productivity and greater reproducibility of results and higher quality garments since the operator can adjust the release of the chain stitch to prevent puckering or imparting undesirable qualities to the finished product. In addition, the novel latchback device provides a scissor action cutting knife and a pneumatic control that is compatible with many other functions of industrial stitching and sewing machines such as raising and lowering of presser foot, positioning of the needle, and other functions to assist in the simplicity of adding the present latchback device to existing equipment to provide reduced cost of operation and increased reliability.

DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

Figure 1:
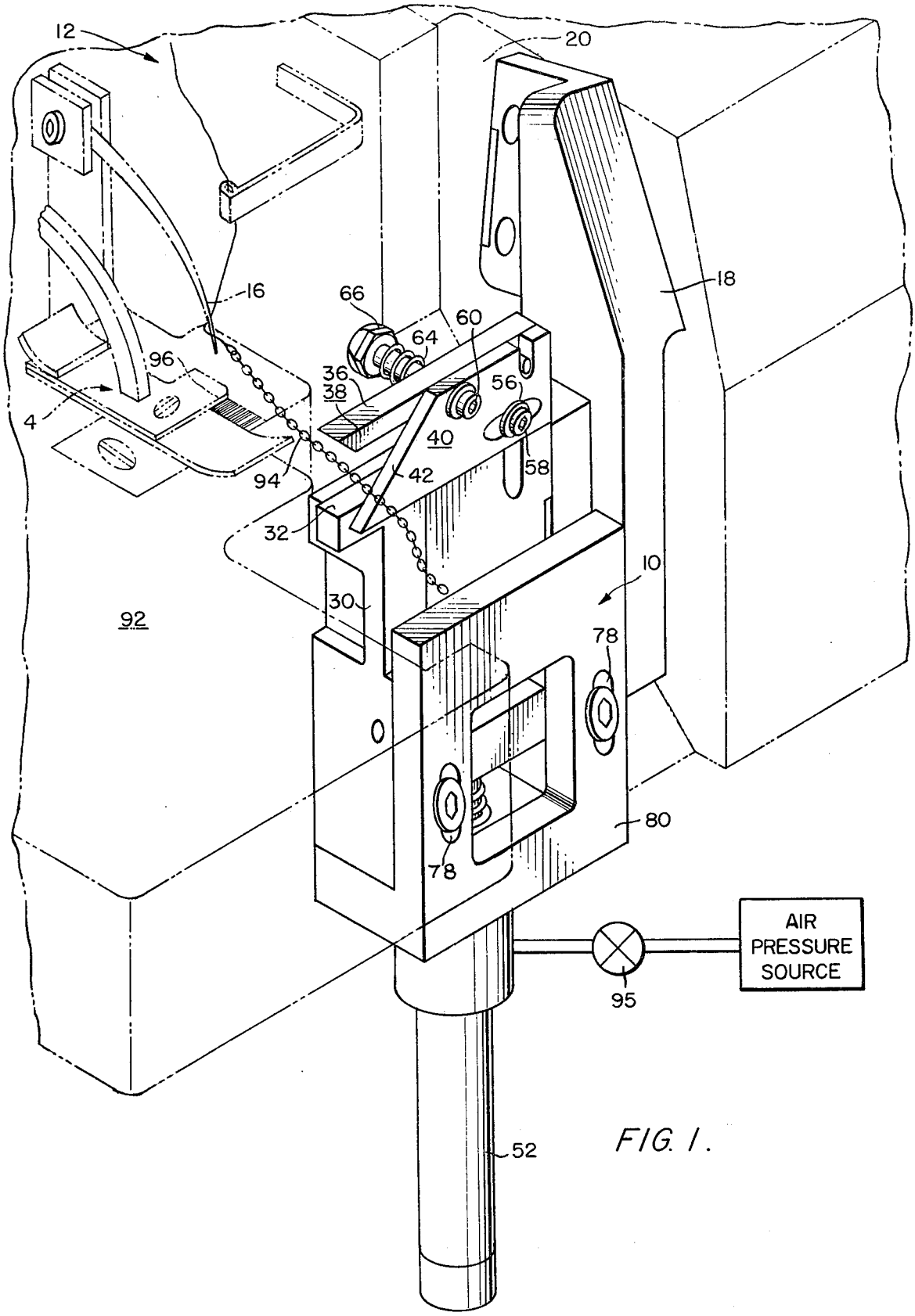
FIG. 1 is a side perspective elevational view illustrating the novel latchback device mounted to a stitching machine and illustrating the stitching needle and presser foot assembly and a portion of the stitching machine.

The novel latchback mechanism is preferably pneumatically activated and operated to automatically maintain the position of the chain stitch, sever the chain stitch between workpieces and assist in locking the leading edge of the chain stitch back into the stitch formation that is even with the leading edge of the next succeeding garment. The latchback device includes a vice shaped clamp formed by the cooperation of an "L" shaped upper clamp having a cutting edge slideably associated with a lower clamp projection which may be part of the assembly housing. The upper clamp in the preferred embodiment is slideably associated with the lower clamp assembly housing by a first slot to provide a slideable mounting of the upper clamp relative to the lower clamp projection.

A knife blade is pivotally mounted relative to the upper clamp by a knife pivot screw and is activated by a combination of a second slot and a knife slide screw and bushing which connects the first slot with the second slot and a means for opening and closing the clamp. A clamp travel stop pin is provided to limit the downward reciprocal travel of the clamp so that upon clamping the knife slide screw and bushing can still travel downwardly in the first slot but that further downward travel results in the knife slide screw and bushing now sliding in the second slot to activate the pivotable knife blade. As will be recognized, the pivotable mounting of the knife blade with respect to the upper clamp in cooperation with first and second slots allows the upper clamp to be closed on the lower projection disposed in the housing to thereafter result in a cutting action by the cooperation of the clamp and the pivoting of the knife blade to sever thread or material maintained therebetween.

A knife and upper clamp slide is preferably connected between the upper clamp and knife and the means for opening and closing the clamp such as an air cylinder so that retraction of a piston in the air cylinder results in the closing of the upper clamp by the sliding of a lower knife slide screw connecting the slot in the upper clamp and the slot in the knife blade. Upon clamping by the contact of the upper clamp and lower clamp projection further retraction of the air cylinder results in the pivoting of the knife blade to sever the trailing edge of the chain stitch from the previously sewn garment or workpiece and the anchoring of the chain stitch in a predetermined position so that it may be incorporated in the underside of the next workpiece or garment.

The next workpiece or garment is then placed over the clamped chain of stitches extending from the sewing machine needle to the novel latchback device. As will be recognized by those skilled in the art, the novel latchback device does not interfere with normal sewing or garment removal procedures or the initiation of sewing operations since the next garment is sewn in the customary manner resulting in the chain of stitches being locked into the intital stitches of the succeeding garment. After a predetermined number of stitches or needle penetrations, which is operator adjustable, the chain is automatically released to prevent puckering while assuring the necessary tension to lock the leading edge of chain stitches in stitch formation. The number of stitches, of course, incorporated in the initial stitches of the workpiece depends not only upon the elasticity and length of the stitches involved but also the type of garment or workpiece being stitched. The novel latchback device of the present invention allows the adjustment of the number of needle penetrations or stitches to take into account these variables before releasing the clamp mechanism so that the stitches are properly drawn and incorporated into the underside of the garment.

The novel latchback mechanism of the present invention operates semi-automatically to incorporate the leading edge of the chain stitch into the next succeeding workpiece. The leading edge of the chain stitch is incorporated in the underside of the workpiece which is the preferred manner of incorporating chain stitches which in addition allows the construction of garments in which the starting stitches are locked into stitch formation and are also even with the leading edge of the garment. The present invention represents an improvement over prior art latchback mechanisms in increasing productivity and increasing the quality of the finished workpiece by providing an automatic release of the leading edge of the chain stitch once a sufficient length of stitches have been locked into the leading edge of the garment to allow the remaining stitches to be locked into stitch formation. The operator adjustable automatic release of the stitch chain depends upon the nature of the cloth sewn, the length and elasticity of the leading end of the stitches which must be taken into account to assure the garments being sewn are not puckered while at the same time assuring that the stitches are properly locked in the underside of the garment.

The novel pneumatic latchback mechanism is designed to operate automatically once the chain of stitches between the stitching needle and the sewn garment are placed in the open clamp and the device is activated by the operator. The novel latchback device is preferably pneumatically operated and may be combined with other pneumatic features such as pneumatic needle positioners to further assist in the function and operation of chain stitching machines. The operation of the latchback device of the invention capitalizes upon the traditional stitching techniques of the sewing machine operator by allowing the removal of the garment in the traditional manner from the back side of the presser foot to the front side of the presser foot to allow the operator to place the chain in the open clamp of the latchback device. The latchback device is thereafter activated by utilizing a knee switch or other conveniently located switch which operates an air cylinder to clamp and automatically sever the chain stitch.

The novel latchback device is typically mounted, level with the stitching or sewing machine table top about one to two inches from the stitching or sewing needle. In the operative embodiment the latchback device is disposed from the needle a distance that corresponds to the length of the leading edge of the chain that is to be incorporated into the initial stitches of the workpiece. The latckback device of the present invention accommodates a wide variation or types of garments, stitch lengths, and elasticity of stitches by allowing the operator to adjust the number of needle penetrations before the chain of stitches is released by the clamp component of the novel latchback device.

Release of the chain of stitches after a predetermined number of needle penetrations or at a particular point in the stitching operation is achieved in the preferred embodiment by the utilization of an adjustable flow control associated with the air cylinder to release pressure on the air cylinder and release the clamp component of the latchback device. Thereafter, the latchback device of the present invention repeatedly and automatically opens the clamp at the selected predetermined point in the sewing cycle to release the chain stitches and to lock the stitches in the workpiece. Once the stitches have been released, the pressure of the cloth and pressor foot maintain the alignment of the stitches on the underside of the garment until they are locked into stitch formation. At the end of the sewing operation the clamp is positioned to receive the chain of stitches from the completed workpiece to again repeat the cycle.

The features of the novel latchback mechanism provide a latchback device that is compatible with a wide variety of stitching and sewing machines that does not impede or encumber the throat plate or presser foot components of the machine or the normal techniques used by the operator. The latchback device of the invention is applicable to garment and shirt operations including the formation of sleeve ends, cuff ends, binding ends, hem bottoms and many other applications in which a chain stitch such as a Federal stitch type 504 is utilized and where a flush end finish is desirable.

Referring now to FIG. 1, the latchback device 10 is illustrated in cooperative association with a portion of a standard stitching machine 12 having a presser foot assembly 14 and a stitching needle 16. Only a portion of stitching machine 12 has been illustrated since such stitching machines which stitch over-edge stitches such as Federal stitch type 504 are well known in the marketplace. The latchback device 10 can be used in conjunction with a variety of such sewing and stitching equipment and is preferably mounted to stitching machine 12 utilizing a mounting bracket 18 which is mounted to a portion of the frame or support 20 of sewing or stitching machine 12. Preferably a pair of latchback height adjusting screws 22 and 24 (FIG. 2) having washers 26 and 28 respectively are mounted through mounting bracket 18 into housing 30 to assist in the vertical positioning of latchback device 10 with respect to presser foot assembly 14 and needle 16.

Figure 2:
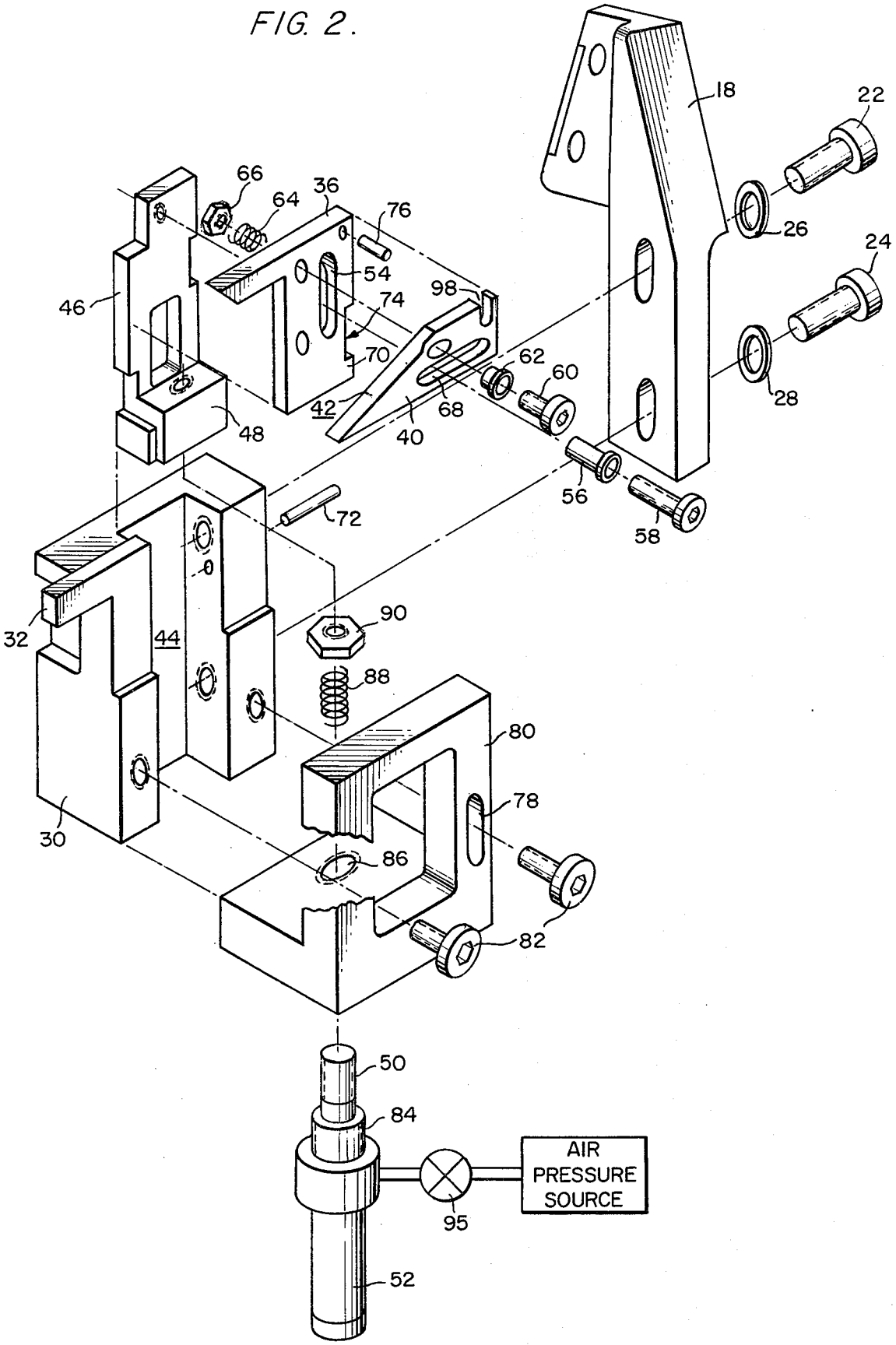
FIG. 2 is an exploded side perspective view partially in section of the novel latchback device illustrating the disposition of the various elements.
Figure 3:
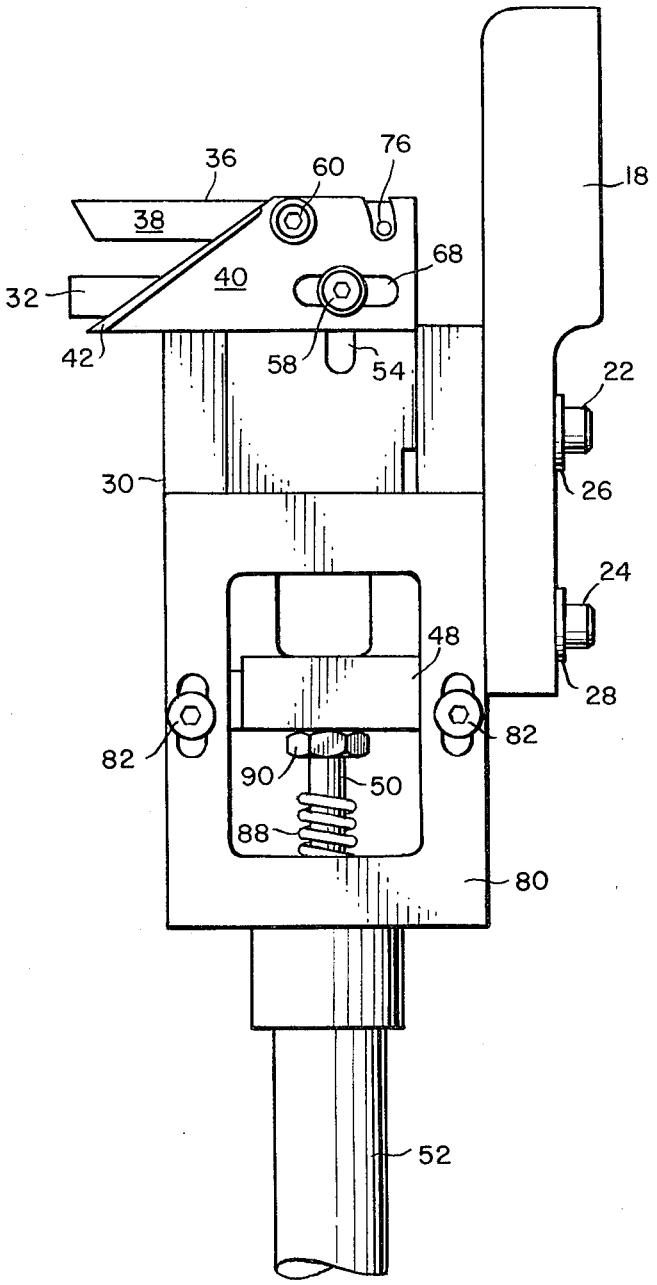
FIG. 3 is a front elevational view of the novel latchback device of FIG. 1.

Referring to FIGS. 1, 2, and 3 the novel latchback housing 30 includes a lower clamp projection 32 of a substantially rectangular configuration which cooperates with an upper clamp 36 which is slideably mounted with respect to housing 30. Upper clamp 36 includes a sharpened knife edge 38 which cooperates with lower clamp projection 32 and a knife blade 40 having a sharpened edge 42 to cut material placed and clamped between upper clamp 36 and lower clamp projection 32 in a manner that will be hereinafter described in greater detail.

Housing 30 includes a rectangular opening 44 for slideably housing a knife and upper clamp slide 46 having a mounting bracket 48 which in the preferred mode is threadably mounted to a piston 50 actuated by a pneumatic air cylinder 52 to provide power for reciprocation of the knife and upper clamp slide 46 in opening 44 of housing 30.

Upper clamp 36 is similarly slideably mounted with respect to knife and upper clamp slide 46 by the combination of a slot 54 provided in upper clamp 36 by a knife slide bushing 56 and knife slide screw 58. Knife slide screw 58 and bushing 56 also attach and pivotally actuate knife blade 40 around knife pivot screw 60 and knife pivot bushing 62. Knife pivot screw 60 and knife pivot bushing 62 are mounted to upper clamp 36 with a compression spring 64 and knife tension adjusting nut 66 which pivotally mount knife blade 40 to upper clamp 36. Knife blade 40 is consequently mounted with respect to upper clamp 36 by knife pivot screw 60. The cooperation among sharpened knife edge 38 of upper clamp 36 and sharpened edge 42 of knife blade 40 along with lower clamp projection 32 and compression spring 64 and nut 66 provide a scissor-like action at a predetermined point in the travel of the knife and upper clamp slide 46 as will be described hereinafter in greater detail.

Slot 68 in knife blade 40, connects knife blade 40 to knife and upper clamp slide 46 via knife slide screw 58 and bushing 56 to maintain the position of knife blade 40 with respect to upper clamp 36 until the downward travel of the upper clamp 36 is impeded by the clamping action resulting when upper clamp 36 is clamped against lower clamp projection 32. At this point, the clamping surfaces of 32 and 36 are in contact to form a clamp which upon further retraction of piston 50 in cylinder 52 and downward travel of knife and upper clamp slide 46 results in the pivoting of knife blade 40 around lower knife pivot bushing 62 due to the further downward travel of knife and upper clamp slide 46 in conjunction with slot 68 and knife slide screw 58. Similarly, the release of air pressure and the activation of piston 50 in an upward direction results in upper clamp 36 moving upward until projection 70 on upper clamp 36 contacts clamp travel stop pin 72. Travel stop pin is disposed in housing 30 in indentation 74 in upper clamp 36. Once travel stop pin 72 is contacted by projection 70 at the end of indentation 74 further upward travel of knife and upper clamp slide 46 results in knife blade 40 pivoting back to its original position. A knife blade travel stop pin 76 is disposed in upper clamp 36 to prevent unwarranted pivotal travel of knife blade 40.

Knife and upper clamp slide 46 is maintained in rectangular opening 44 of housing 30 by a cylinder mounting bracket 80. Cylinder mounting bracket 80, has two slots 78 (FIG. 1) for adjustably mounting bracket 80 to housing 30 by two cylinder mounting brackets screws 82. Air cylinder 52, is preferably threadably mounted to cylinder mounting bracket 80 by threads 84 disposed on cylinder 52 and corresponding threads 86 in mounting bracket 80. A cylinder compression spring 88 and a cylinder rod locking nut 90, is disposed on threads on the end of piston 50 which are also threadably engaged in mounting bracket 48 of knife and upper clamp slide 46.

Referring now to FIGS. 1 and 3–6, the operation and application of the novel latchback device to stitching and sewing machines will be described in greater detail. The latchback device as illustrated in FIG. 1, is mounted about 1 to 2 inches from the stitching needle 16 of a sewing or stitching machine 12. The lower clamp projection 32 is preferably mounted flush with the table top 92 of the stitching machine 12. In operation the sewing machine operator sews the garment in the normal manner leaving a thread chain 94 which is generally on the trailing edge of the garment that has been sewn which is of a sufficient length to reach from the needle 16 to the opening between lower clamp projection 32 and upper clamp 36 of the latchback device. The needle 16 is then positioned at the highest point and the presser foot assembly 14 is raised to enable the machine operator to release the stitch chain from the throat plate tongue 96 of the stitching machine 12. In the preferred embodiment of the present invention, the positioning of needle 16 at the highest point in the stitching cycle is accomplished by the utilization of a pneumatic needle positioner device that is compatible with the novel pneumatically activated and controlled latchback device.

Figure 4:
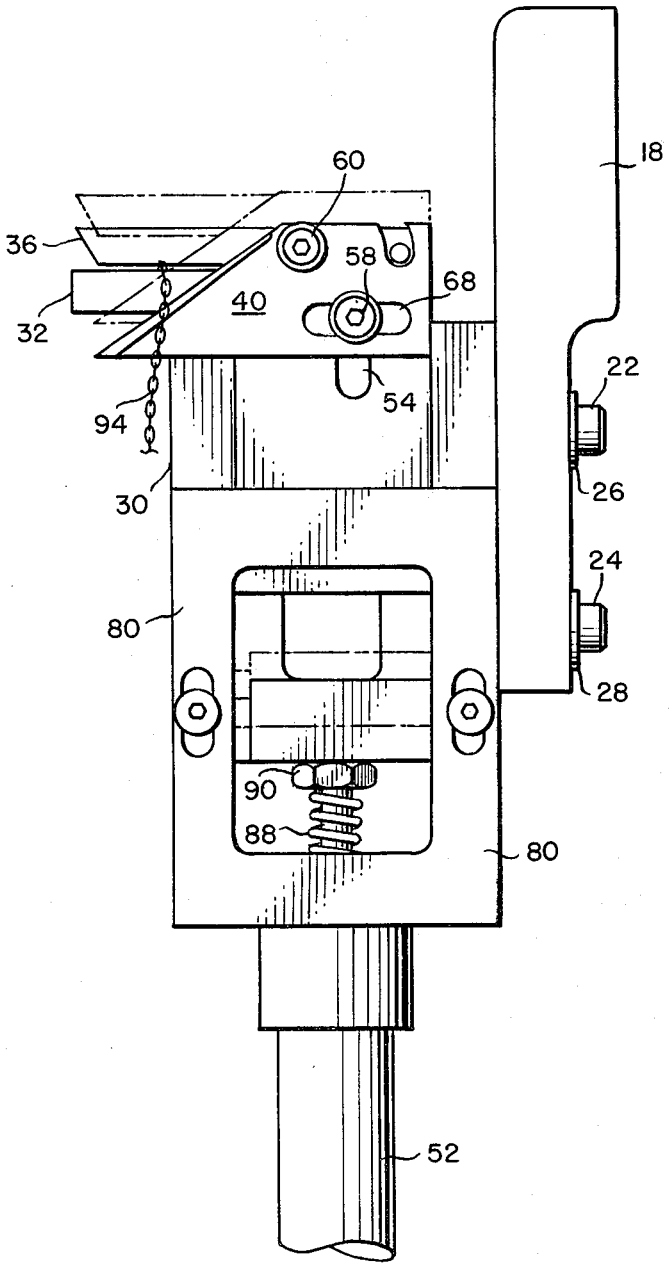
FIG. 4 is a front elevational view similar to FIG. 3 illustrating the clamping operation of the novel latchback device.
Figure 5:
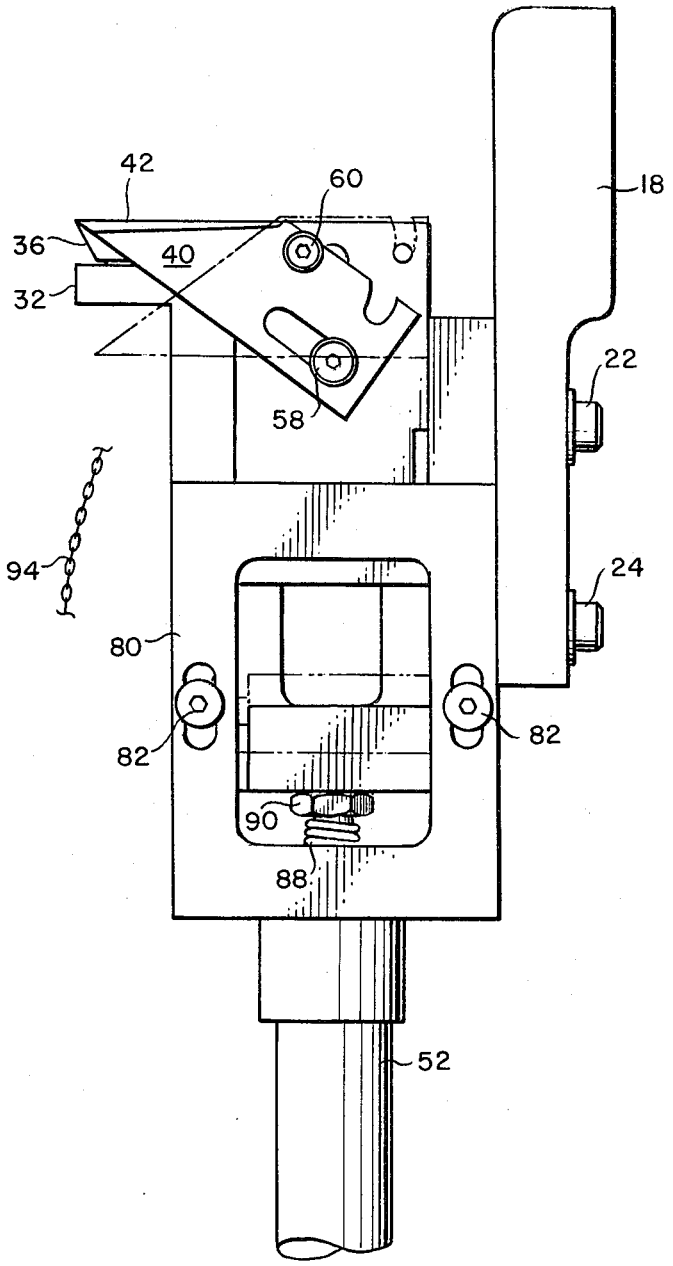
FIG. 5 is a front elevational view similar to FIG. 4 illustrating the operation of the clamp and cutting action of the novel latchback device.

The released chain of stitches which trails from stitching needle to the end of a garment (not shown) is positioned between the lower clamp projection 32 and upper clamp 36 of the latchback device 10. The operator thereafter activates a pneumatic switch which in the preferred embodiment consists of a knee switch (not shown) which is known in the art to allow air to enter the top of the pneumatic air cylinder 52 which then moves piston 50 downward to result in upper clamp 36 clamping thread chain 94 against lower clamp projection 32 as is illustrated in FIG. 4. Once thread chain 94 is clamped between lower clamp projection 32 and upper clamp 36, the knife and upper clamp slide 46 continues traveling downward resulting in edge 42 of the knife blade 40 to travel and pivot upwardly resulting in the severing of thread chain 94 as is illustrated in FIG. 5. Generally one portion of thread chain 94 is attached to a piece of cloth or a previous workpiece that has been sewn. The portion of thread chain 94 that remains between lower clamp projection 32 and upper clamp 36 forms the leading end of the chain stitch that will be incorporated into the initial stitches of the subsequent garment or workpiece.

The novel latchback device thereafter remains in the position as illustrated in FIG. 5 until the operator starts the stitching or sewing machine. In FIG. 5, the piston has been fully retracted into cylinder 52 resulting first in the downward travel of knife slide screw 58 in slot 54 which subsequently resulted in the pivoting of knife blade 40 around knife pivot screw 60. The closing of the clamp results in further downward travel of piston 50 in cylinder 52 causing the pivotable movement of knife blade 40 around knife pivot screw 60. The full downward travel of piston 50 in cylinder 52 as illustrated in FIG. 5 has also resulted in the compression of cylinder compression spring 88 which remains compressed until the sewing machine operator again starts operation of the sewing machine.

The novel latchback device in maintaining the position as illustrated in FIG. 5 until the operator starts the machine allows the operator to place a second workpiece over the portion of thread chain 94 that is disposed between needle 16 and the clamp formed by lower clamp projection 32 and upper clamp 36 of latchback device 10. Once the garment is positioned over the portion of thread chain 94, the sewing machine operator starts operation of the machine by pressing the foot pedal of the stitching machine which not only starts the sewing machine but also energizes an adjustable pneumatic flow control valve 95 connected to the top of cylinder 52 to begin bleeding off pressure that allows the upward travel of piston 50 in cylinder 52.

The speed of the gradual release of air pressure in cooperation with cylinder compression spring 88 results in the upward travel of piston 50, and results in clamp projection 32 and upper clamp 36 releasing the thread chain 94 after a predetermined period of time or needle penetrations. This operator adjustable feature provides for a high degree of reproduceability and allows the thread chain 94 to be incorporated and locked into the starting stitch that is flush with the leading end of a garment and is incorporated into the stitches on the underside of the garment without puckering or ruffling the stitches of the garment.

In the preferred embodiment, the time delay corresponding to a predetermined number of needle penetrations is achieved by a flow control valve. One such standard flow valve is the ⅛ type DELTROL Model No. F10 BK manufactured by M&M Manufacturing Company of Bellwood, Ill. Typically, such adjustable flow control valves or other delay release means should provide a time delay corresponding from about 3–50 needle penetrations.

The operator adjustable nature of the delay for releasing the clamp after a predetermined number of needle penetrations is necessary to insure the leading edge of stitches are properly locked in the garment while at the same time preventing an accordian or puckering effect in the garment. The release made for the opening of lower clamp projection 32 and upper clamp 36 may therefore be gradual to allow the stitching of the machine to take up and tightly incorporate the leading edge of the stitch in the underside of the garment in the initial stitches of the sewing operation and also maintain the thread chain 94 in a straight position for incorporation in the underside of the seam.

Figure 6:
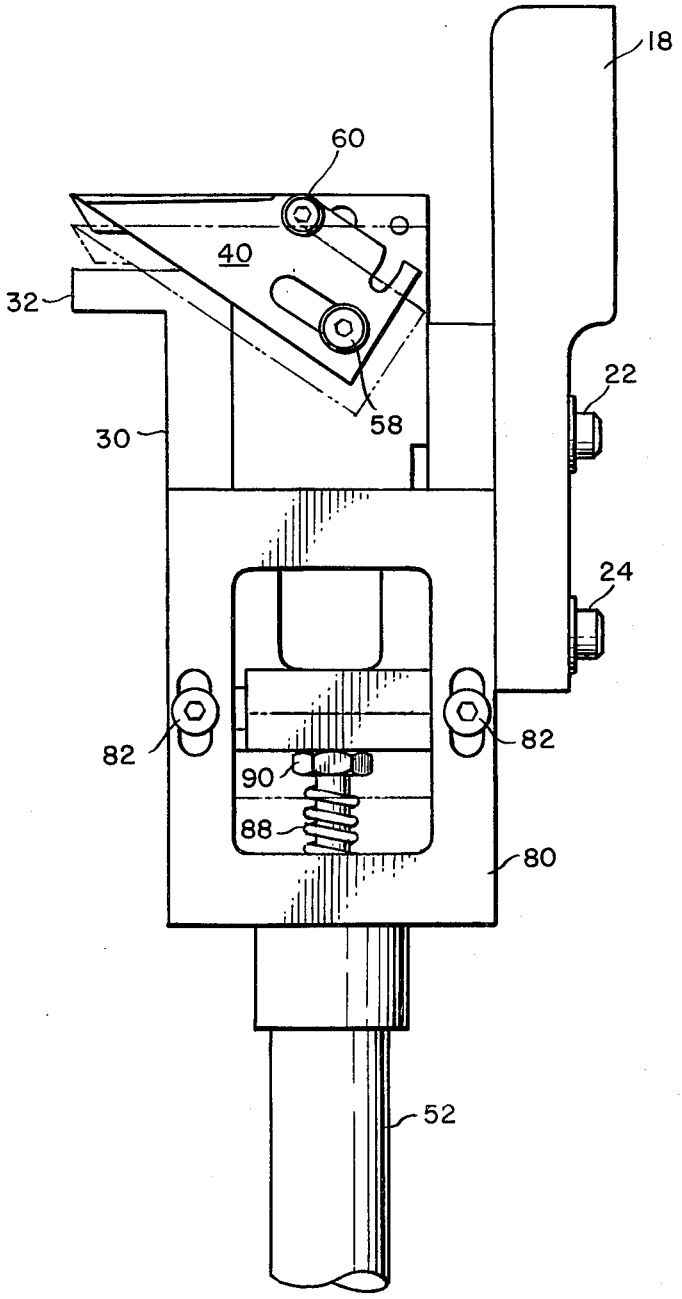
FIG. 6 is a front elevational view of the novel latchback device similar to FIG. 5 illustrating the release of tension on the clamping component after a predetermined number of needle penetrations to allow the leading edge to the chain stitch to be drawn into and incorporated in the workpiece.

Upon completion of the sewing operation, the operator heels back on the stitching machine pedal which stops the stitching machine and also opens a pneumatic valve in the bottom of cylinder 52 to introduce air pressure and fully extend piston 50 in cylinder 52 to extend knife and upper clamp slide 46 to open the clamp and thereafter begin pivoting knife blade 40 as is illustrated in FIG. 6.

The knife and upper clamp slide 46 continues its upward travel until the knife slide screw 58 and bushing 56 slide in slots 54 and 68 to a stop position resulting when the indentation 98 on knife blade 40 contacts stop pin 76 to stop the pivotal positioning of knife blade 40.

The novel latchback apparatus is once again in a position as illustrated in FIG. 3 and is again ready to receive a chain stitch for cutting and clamping as previously described. Simultaneously, with the opening and positioning of the clamp and knife blade 40, the operator after stopping the machine begins to chain out a sufficient stitch chain to reach from needle 16 to the clamp formed by upper clamp 36 and lower clamp projection 32. The operator once again then positions the stitch chain and again activates the pneumatic switch for clamping and cutting in the sequence as has heretofore been described.

The novel latchback device of the present invention assures the production of higher quality garments by providing greater reliability while providing a latchback device that is economical to construct and to operate. In addition, the novel latchback mechanism of the present invention allows for more productivity since it does not interfere with the normal sewing techniques of stitching machine operators. As a result, there is reduction in operator training time and an increase in the quality of garments and workpieces provided by the latchback device. In addition, the novel device is operator adjustable to accommodate a variety of sewing and stitching applications and to increase or decrease the tension in the stitches that are incorporated in the garment to provide greater repeatability.

Thus it will be recognized by those skilled in the art, that the present invention has a wide range of applicability to a variety of sewing and stitching machines and is readily added to new or existing equipment without extensive modification. The invention furthermore may be implemented in a variety of ways to achieve the advantages of the invention and may be constructed in any size to allow the cutting of the stitches, cloth, or other materials of greater density than chain stitches in applications where it is desirable to incorporate a portion of the material back into the next succeeding device.

It will be recognized that modification and changes may be made in the arrangement and disposition of the mechanical components of the present invention to achieve the same result and function. It will be further appreciated that the present invention may be implemented in a variety of ways to suit the particular application of the latchback device to particular types of sewing and stitching machines to achieve the advantages of the present invention. Consequently, it is intended that these and other modifications and applications of the present invention to a variety of systems may be made within the spirit and scope of the invention as defined in the following claims.

What is claimed is:

1. A device for engaging, cutting, and releasing a leading edge of threads for incorporation in a workpiece comprising:

(a) a housing;

(b) a support member forming the first element of a clamp;

(c) a first slideable member disposed in said housing;

(d) a second slideable member slideably disposed within limits in said first slideable member and said housing forming the second element of said clamp;

(e) a knife pivotally mounted on said second slideable member and pivotally actuated by said second slideable member;
(f) a pneumatically controlled cylinder; and
(g) an actuating rod disposed in said cylinder for actuating said first slideable member.

2. The device for engaging, cutting, and releasing a leading edge of threads for incorporation in a workpiece of claim 1 further comprising a biasing spring disposed between said first slideable member and said actuating rod.

3. The device for engaging, cutting, and releasing a leading edge of threads for incorporation in a workpiece of claim 1 further comprising an adjustable flow control valve for gradually releasing air pressure in said cylinder.

4. The device for engaging, cutting, and releasing a leading edge of threads for incorporation in a workpiece of claim 3 wherein said support member is part of said housing.

5. The device for engaging, cutting, and releasing a leading edge of threads for incorporation in a workpiece of claim 3 wherein said second slideable member slides within limits with respect to said first slideable member and said housing by the utilization of a pin disposed through said housing for limiting the movement of said second slidable member.

6. The device for engaging, cutting, and releasing a leading edge of threads for incorporation in a workpiece of claim 5 wherein said second slideable member is connected to said first slideable member by a screw associated with a slot in said second slideable member.

7. The device for engaging, cutting, and releasing a leading edge of threads for incorporation in a workpiece of claim 6 wherein said knife is pivotally mounted with respect to said second slideable member by said screw associated with a slot in said knife.

8. The device for engaging, cutting, and releasing a leading edge of threads for incorporation in a workpiece of claim 3 wherein said second slideable member includes a cutting edge.

9. A device for engaging, severing, and incorporating the leading edge of a material into the next succeeding workpiece comprising:
(a) a clamp having an upper and lower clamping element;
(b) a knife blade pivotally mounted on and pivotally activated by one of said clamping elements;
(c) a pneumatically controlled cylinder for opening and closing said clamping elements; and
(d) an adjustable flow control valve for releasing air pressure in said cylinder.

10. The device for engaging, severing, and incorporating the leading edge of a material into the next succeeding workpiece of claim 9 wherein said pneumatically controlled cylinder is operatively connected to said upper clamping element.

11. The device for engaging, severing, and incorporating the leading edge of a material into the next succeeding workpiece of claim 10 wherein a spring is interdisposed between said clamping element and said pneumatically controlled cylinder.

12. The device for engaging, severing, and incorporating the leading edge of a material into the next succeeding workpiece of claim 11 wherein said knife blade is pivotally mounted to and pivotally actuated by said upper clamping element.

13. The device for engaging, severing, and incorporating the leading edge of a material into the next succeeding workpiece of claim 12 wherein said upper clamping element includes a first slot and said knife blade includes a second slot perpendicular to said first slot.

14. A method of incorporating sewing threads or stitches into the initial stitches on the reverse side of a garment that is being sewn comprising:
(a) sewing a workpiece and clamping the trailing end of threads or stitches from a sewing needle to a clamping device;
(b) pivotally moving a blade to sever the threads or stitches after clamping wherein said blade is attached to said clamping device;
(c) maintaining the trailing end of said threads or stitches in a predetermined position with said clamp; and
(d) releasing the trailing end of stitches into the initial stitches on the underside of a workpiece upon attaining a predetermined number of initial stitches or sewing needle penetrations.

15. The method of incorporating sewing threads or stitches into the initial stitches on the reverse side of a garment that is being sewn of claim 14 wherein said releasing is accomplished by slowly relieving the tension on said clamp.

16. The method of incorporating sewing threads or stitches into the initial stitches on the reverse side of a garment that is being sewn of claim 16 wherein said clamping is accomplished by a pneumatic cylinder and wherein said releasing is accomplished by providing an adjustment for gradually releasing the air in said cylinder and the resulting clamp force.

17. The method of incorporating sewing threads or stitches into the initial stitches on the reverse side of a garment that is being sewn of claim 15 wherein said releasing is accomplished after sewing about 3 to 30 stitches.

* * * * *